United States Patent [19]

Johnsen

[11] 4,033,611

[45] July 5, 1977

[54] MULTI-PLY LOTTERY TICKETS OR LIKE ARTICLES, CONTINUOUS BUSINESS FORM AND METHOD FOR PRODUCING SAME

[76] Inventor: Edward L. Johnsen, 12 Fox Meadow Lane, Wayland, Mass. 01778

[22] Filed: July 14, 1975

[21] Appl. No.: 595,733

Related U.S. Application Data

[62] Division of Ser. No. 433,461, Jan. 15, 1974, Pat. No. 3,940,124.

[52] U.S. Cl. ..... 283/6

[51] Int. Cl.[2] ..... B42D 15/00

[58] Field of Search ..... 283/6, 8; 270/61 F; 273/139; 282/12 R

[56] References Cited

UNITED STATES PATENTS

| | | | |
|---|---|---|---|
| 1,509,525 | 9/1924 | Murray et al. | 282/12 A |
| 2,023,829 | 12/1935 | Wright | 283/6 |
| 3,512,780 | 5/1970 | Allison | 283/8 R |

FOREIGN PATENTS OR APPLICATIONS

| | | | |
|---|---|---|---|
| 2,226,601 | 12/1970 | Germany | 283/6 |
| 1,185,066 | 3/1970 | United Kingdom | 283/6 |

*Primary Examiner*—Lawrence Charles
*Attorney, Agent, or Firm*—J. Warren Kinney, Jr.

[57] ABSTRACT

A multi-ply lottery ticket or like article is formed from a single sheet of material transversely accordion folded into a set of three contiguous panels disposed in registered zig-zag relationship. The articles are formed from an endless web of sheet material transversely subdivided into a series of connected blanks each of which is transversely trisected into a set of three contiguous panels spanning the full width of the web, wherein portions of each surface of the web are provided with adhesive which is not activated for adhering to other panels until after original indicia has been applied to an upper surface of at least one panel of each blank. Thereafter, each set of panels is accordion folded into registered zig-zag relationship, abutting panels permanently bonded to one another, producing the continuous series of multi-ply tickets or like articles.

8 Claims, 24 Drawing Figures

FIG-1
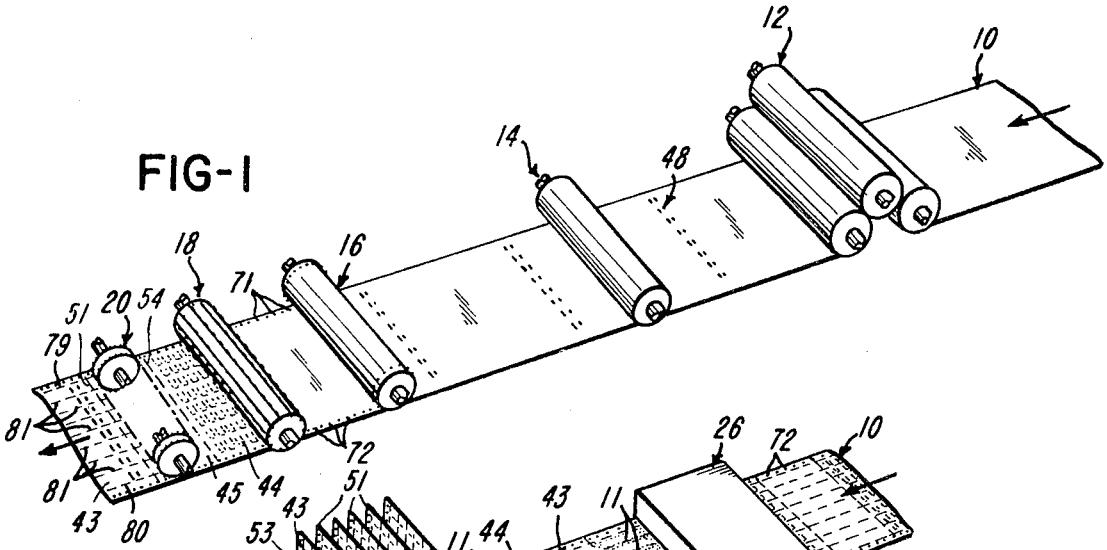
FIG-2
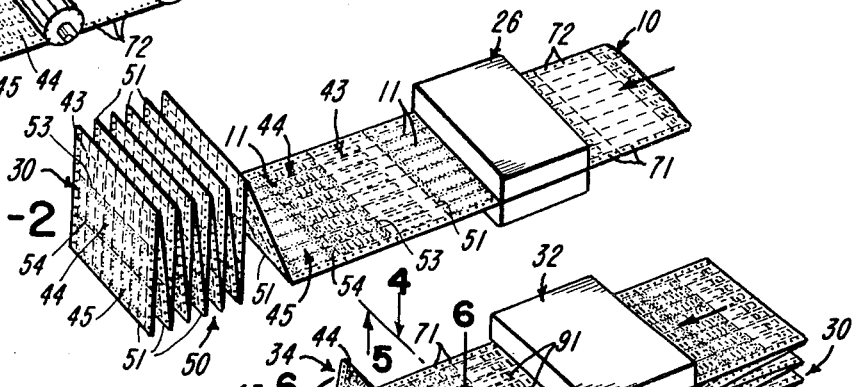
FIG-3
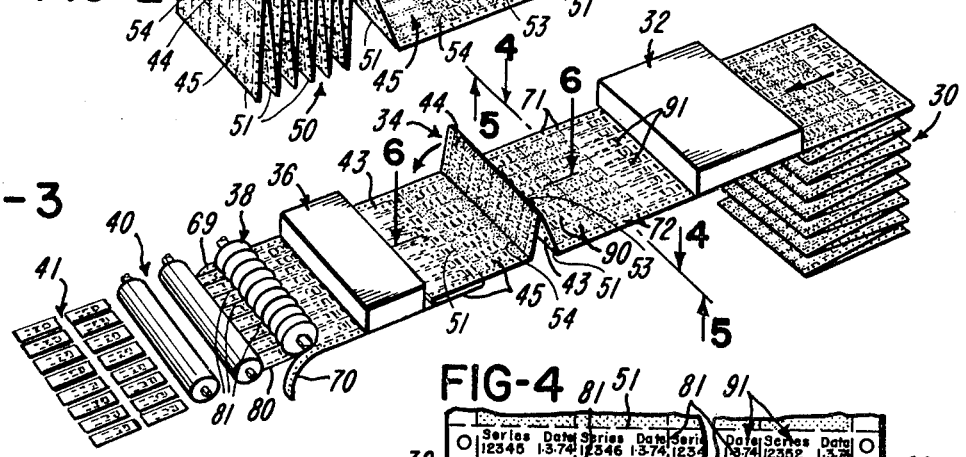
FIG-4
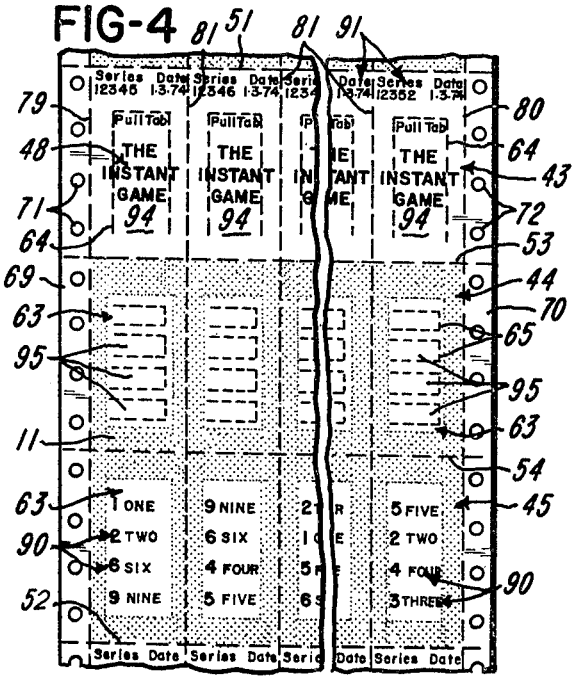
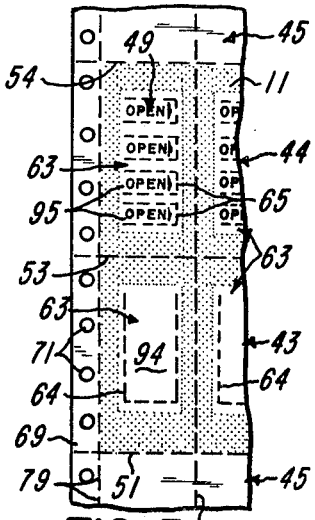
FIG-5

FIG-12
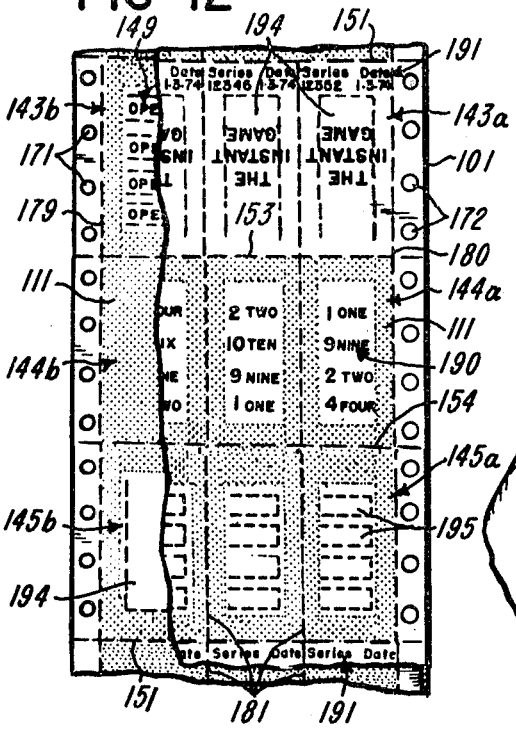
FIG-13
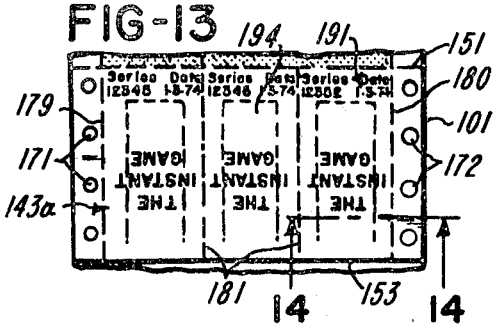
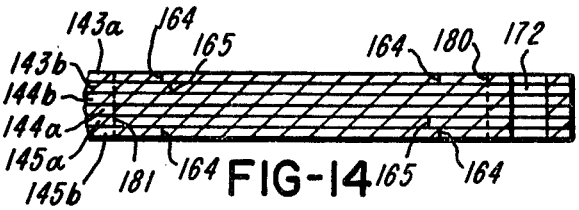
FIG-14
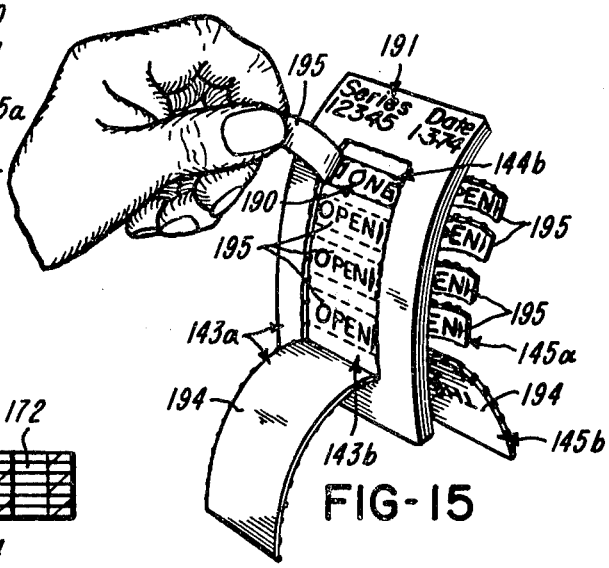
FIG-15
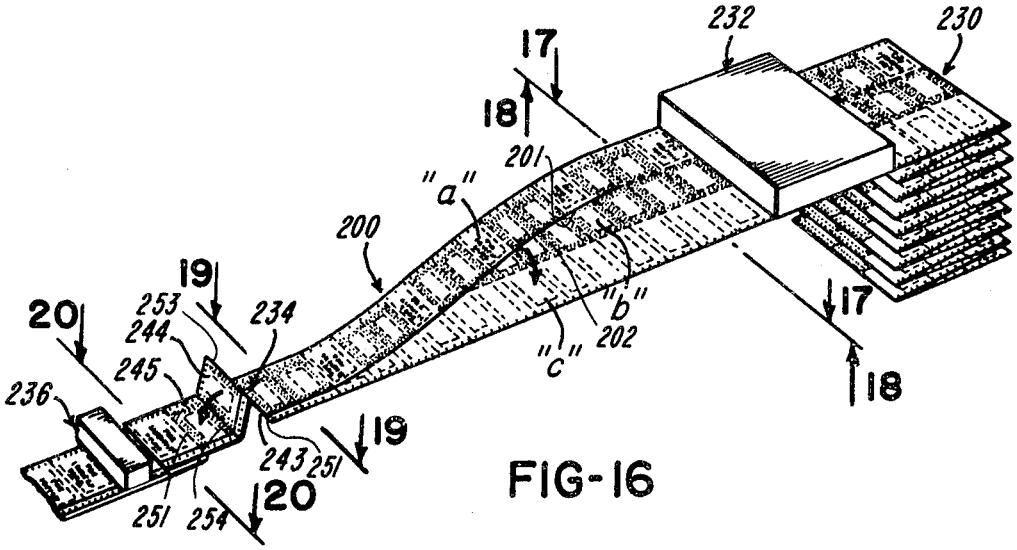
FIG-16

MULTI-PLY LOTTERY TICKETS OR LIKE ARTICLES, CONTINUOUS BUSINESS FORM AND METHOD FOR PRODUCING SAME

This is a division of application Ser. No. 433,461, filed Jan. 15, 1974, now U.S. Pat. No. 3,940,124, issued Feb. 24, 1976.

CROSS REFERENCE TO RELATED APPLICATIONS

My patent application Ser. No. 433,463, filed Jan. 15, 1974 and my U.S. Pat. No. 3,956,049 each specifically disclose a particular genus of continuous business forms, the resulting articles and corresponding methods of manufacture.

U.S. Pat. No. 3,956,049 discloses a form wherein original indicia may be applied directly to separate surfaces of a cover ply and under ply of an article formed from a continuous web having at least three longitudinally extending co-planar panels, comprising a cover panel and an under ply panel separated by an intermediate discardible panel wherein one of the ply panels is disposed in overlying relationship with the discardible panel, thereby placing separate surfaces of the ply panels in side-by-side juxtaposition for application of indicia.

Application Ser. No. 433,463 discloses a form wherein original indicia is confined to the under ply of the article and the cover ply, when placed in overlying relationship with the under ply, conceals only selected portions of the original indicia.

Application Ser. No. 433,462, filed Jan. 15, 1974, abandoned for continuation application Ser. No. 633,490, filed Nov. 19, 1974 utilizes the teachings of either Ser. No. 433,463 or those of U.S. Pat. No. 3,956,049 in combination with a method for collating a plurality of continuous webs into registered overlying relationship for producing a series of stuffed, sealed envelopes or the like including in some instances an attached return envelope form.

BACKGROUND OF THE INVENTION

1. Field of the Invention

The field of the invention relates generally to business forms, particularly to a continuous form which comprises a series of connected blanks suitable for subsequent processing into multi-ply lottery tickets or like articles which contain original, directly applied concealed indicia on an under ply. As used herein, the term "original indicia" excludes preprinted indicia and indicia applied by transfer means such as carbon paper and the like. Each blank comprises articles such as lottery tickets or the like having at least three disposed in registered zig-zag relationship, wherein abutting plies are permanently secured to one another forming a sealed pocket therebetween and wherein original, directly applied indicia is contained on the interior surface of at least some of the sealed pockets, the concealed indicia being exposable through access to the pockets.

2. Description of the Prior Art

A number of patents have been issued disclosing a variety of articles of multi-ply construction having an interior, exposable pocket for containing concealed indicia, such as with lottery tickets or the like. However, the previous embodiments do not disclose a continuous web permitting single run application of original, directly applied indicia to both the interior surface of the pocket and to the exterior face of the article.

The prior art as it relates to lottery tickets is present in two different formats. The first format includes original indicia in a concealed pocket having acceptable tamperproof features as exemplified by U.S. Pat. Nos. 2,108,749 and 2,180,808. Each of these patents disclose a lottery ticket having original indicia on one panel which is concealed by another panel in overlying relationship therewith, the overlying panel being partially or completely removable from the indicia-bearing panel to selectively expose the indicia thereon. None of these patents disclose or suggest a lottery ticket capable of being produced by mass production techniques nor do they provide for the simultaneous and direct application or original indicia to both the ticket face and the interior pocket surfaces.

The second ticket format is illustrated in U.S. Pat. No. 2,023,829 which discloses a lottery ticket permitting of mass production, however the ticket is not acceptable for use in lottery games of the type which require tamperproof, high security features. As with the first ticket format, there is no provision for the simultaneous application of original, directly applied indicia to both an exterior surface and an interior concealed surface of the final article.

SUMMARY OF THE INVENTION

The present invention is directed to a method of producing a series of connected blanks which are particularly suited for subsequent processing into multi-ply lottery tickets or like articles; to the blanks per se; and to articles formed therefrom.

An endless web of sheet material is transversely subdivided into a series of interconnected blanks each of which is transversely trisected into a set of three contiguous panels each spanning the full width of the web. Each blank defines a multi-ply article such as a lottery ticket or the like wherein the various plies are formed from a single flat sheet of material, the contiguous panels accordion folded into registered zig-zag relationship to form the various plies of the article. Adhesive is selectively applied to portions of each surface of the web, after which the individual blanks are suitably accumulated for later use.

When later used, the individual, interconnected blanks are fed to a computer or the like where the indicia is applied to the upper exposed surface of at least one panel of each set of contiguous panels. Each set of panels is then accordion folded into registered zig-zag relationship defining a multi-ply lottery ticket or like article having indicia on at least one concealed ply thereof. Abutting panels are then permanently bonded to one another by means of the adhesive initially applied, thereby completing each article which is then adapted to be severed or otherwise separated from the interconnected blanks of the web in the form of the completed lottery ticket or the like.

Several embodiments of the invention provide for subdividing each panel of the sets of panels, then folding the sub-panels into overlying relationship producing a series of blanks each defined by a set of three contiguous multi-ply panels which when accordion folded generate multi-ply articles of six or more plies.

It is, therefore, an object of the present invention to provide a method of making a series of interconnected blanks suited for subsequent processing into multi-ply lottery tickets or the like having a concealed pocket bearing original, directly applied indicia.

It is further an object of the invention to provide a unique form defining the interconnected blanks.

It is further an object of the invention to provide a multi-ply lottery ticket defined by a single sheet of material transversely accordion folded into a set of three contiguous panels disposed in registered zig-zag relationship.

It is yet another object of the invention to provide a family of articles conforming to the various other objectives of the present invention, to wit: a lottery ticket having substantially tamperproof features for use with games of chance, particularly as utilized and required by state lottery systems or the like, wherein it is desirable if not necessary that both an interior surface of the pocket of the ticket and an exterior face of the ticket contain original, directly applied indicia.

Other objects and features of the invention will be readily apparent from the following detailed description.

SUMMARY OF THE DRAWINGS

FIGS. 1, 2 and 3 diagrammatically illustrate steps in the method of making the continuous form comprising a series of interconnected blanks, and the articles incorporating features of the present invention.

FIGS. 4–8 illustrate the various steps for producing a continuous form by the process of FIGS. 1–3 and a lottery ticket obtained therefrom.

FIGS. 10–15 illustrate the various steps for producing a second continuous form by the process of FIGS. 1–3 when including the modification of FIG. 9, and a lottery ticket obtained therefrom.

FIG. 16 diagrammatically illustrates a modification in the steps of the method of FIGS. 1–3.

DETAILED DESCRIPTION OF THE DRAWINGS

Figure 6:
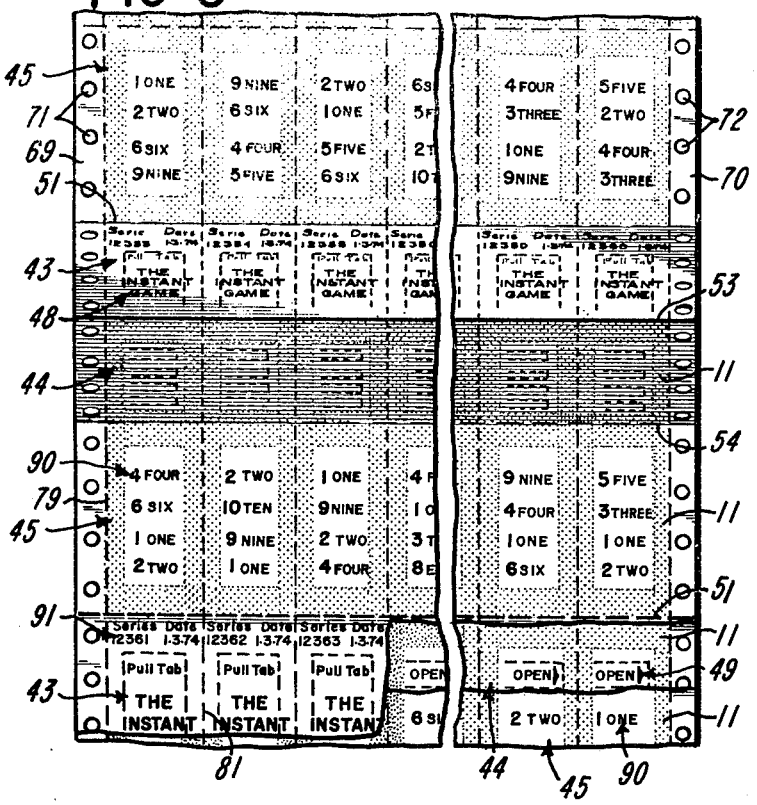

The continuous form of the present invention defines a series of interconnected blanks uniquely to receive indicia on a plurality of the panels thereof. The form is designated generally by the reference numeral 30 as illustrated particularly in FIG. 2, and is adapted to be subsequently processed into lottery tickets or like articles wherein the final article includes a closed pocket for carrying concealed indicia. The present form is unique in that it permits simultaneous application of original, directly applied indicia to an internal surface of the pocket and to a face of the article in a single printing procedure.

The steps required to produce the continuous form of the present invention are illustred generally in FIGS. 1 and 2 and comprise: (1) continuously advancing a properly prepared endless web of material 10 toward an accumulating station 50; (2) transversely subdividing the web at station 18 into a continuous series of interconnected blanks; and, simultaneously, (3) trisecting each blank at station 18 into a set of three contiguous panels 43, 44 and 45; (4) selectively applying a so-called initially inactive adhesive 11 to a portion of each surface of the web at 26; and (5) accumulating the form 30 at 50 for later use.

The preliminary steps required to prepare the web 10 are shown generally in FIG. 1 and will vary somewhat depending upon the configuration of the final article Generally, certain identifying and instructional indicia 48 and 49 is applied on either or both surfaces of the web at printer 12. Inventory control data may be added at station 14, and may include, for example, run number, dat, form style number or similar information. This control data is generally added to a discardible portion of the form and is deleted from the final article. It is often desirable to add one or more continuous series of line holes 71 and 72 at punch station 16. Line holes are adapted to be engaged by sprocket gears or the like whereby the finished form is advanced through subsequent processing stages. The form often includes a series of side-by-side articles, see FIGS. 4–6, which may be separated along lines 81 provided at station 20. While each of these steps are preliminary and may be performed in any order, with certain steps added and others deleted depending only upon the configuration of the final article, it should be understood that certain preliminary preparation of the web 10 is generally essential to generation of the continuous form 30.

The form 30, as illustrated in FIG. 2, is particularly suited for subsequent processing into lottery tickets or the like having a concealed pocket and an exterior face each bearing original, directly applied indicia. The web is either fan or accordion folded at 50 as illustrated, stored on a continuous roll, or otherwise accumulated in any well-known manner for subsequent use.

The subsequent processing steps, illustrated in FIG. 3, produce a final article from the form 30 of FIG. 2. The continuous form is advanced through a controlled printing process 32 wherein original indicia 90 and 91 is applied to the upper surface of the web. The form is then accordion folded at station 34, placing each set of contiguous panels 43, 44 and 45 in registered zig-zag relationship thereby forming a multi-ply article from the single, flat sheet of material which defines each article blank.

The initially inactive adhesive coating 11 applied at station 26 forms a permanent seal between and permanently bonds abutting panels to one another to generate a closed pocket containing concealed, originally applied indicia. One example of an initially inactive adhesive is a hot-melt glue of the type having an affinity for the surface of the web 10 when applied at station 26, quickly becoming inactive, as that term is used herein, until heated by a heat source located at station 36. Glue of this type is applied in an adherent, tacky, liquified state, thereafter transformed to a non-tacky state in which it remains until heated at station 36. It should be understood that other types of adhesive bonding could be utilized without departing from the spirit of the invention. One such example is known as self-stick adhesive wherein the adhesive once applied will not adhere to anything but another coating of the same adhesive. Utilization of this adhesive would require replacement of the heat source at station 36 with a nip-roll for applying pressure to the adhesive contact areas. It should be understood that for purposes of the present disclosure and claims an adhesive of the self-stick type is considered initially inactive, and is said to be activated when placed in direct contact with another surface having the same adhesive coating.

After sealing the printed form, the excess and marginal regions 69 and 70 including line holes 71 and 72 may be removed at station 38 and the side-by-side series of tickets may be separated along lines 81 into a plurality of parallel continuous ticket strips which are separated into individual items at station 40 for distribution at station 41.

Thus, the basic continuous form 30 is generated by the steps illustrated in FIGS. 1 and 2 from a continuous web of material properly prepared as illustrated by steps in FIG. 1. It should be understood that some of the preliminary steps illustrated could be performed subsequent to glue-application station 26 if desired. The steps subsequent to generation of the continuous form 30 are illustrated in FIG. 3, and are utilized to produce a final article from the form of FIG. 2.

Therefore, FIGS. 1, 2 and 3 illustrate steps in the method of making the continuous form, the continuous form per se, and in general a final article meeting the objectives of the present invention. By utilizing an endless web transversely subdivided into a series of connected blanks each transversely trisected into three contiguous panels 43, 44 and 45, it is possible to directly apply original indicia 90 and 91 to a plurality of the plies of a multi-ply article in a single, continuous printing process.

FIG. 4–8 illustrate an embodiment of the invention utilizing the teachings of the present invention as particularly illustrated in FIGS. 1–3. FIGS. 9–24 illustrate modifications in the process and the resulting article utilizing in general the steps in the method of FIGS. 1–3. While the varous embodiments and modifications vary with respect to detail, the principle of each is identical, i.e., achieving a final multi-ply article from a single sheet of material, the article article including directly applied, original indicia on at least one concealed surface of a pocket formed between abutting plies.

The first embodiment of the continuous form 30, produced by utilizing the steps as particularly illustrated in FIGS. 1, 2 and 3, and the resulting article obtained therefrom is illustrated in FIGs. 4–8. While the embodiment therein disclosed includes independent transversely spaced blanks each including a plurality of articles in parallel side-by-side relationship, it should be understood this is merely illustrative and not intended to be restrictive or limiting. The number of side-by-side articles contained in each blank is limited only by the desired size of the final article.

The upper surface of form 30, as produced by the process of FIGS. 1 and 2, and after application of indicia at printer 32, is illustrated in FIG. 4 taken at line 4—4 of FIG. 3. The lower surface is illustrated in FIG. 5 taken at line 5—5. The form is transversely subdivided by lines 51 and 52 or the like into a blank which is transversely trisected by lines 53 and 54 into a set of three contiguous panels 43, 44 and 45 each spanning the full width of the web and defining at least one complete article.

Adhesive 11 is supplied at station 26 to at least both sides of the centralmost panel 44 and where a self-stick adhesive or the like is utilized also to the upper surface of panel 45, see FIG. 4, and the lower surface of panel 43, see FIG. 5. The adhesive completely surrounds uncoated regions 63 of each panel, forming a complete adhesive barrier about the periphery thereof. In the present embodiment the width of the form is separated into a plurality of side-by-side articles by longitudinally extending lines 81, see also FIG. 6, and includes lines 79 and 80 facilitating in the removal of the excess marginal regions 69 and 70 including line holes 71 and 72.

A series of U-shaped tear lines 64 are provided in panel 43, generating a hinged tear strip 94 providing access to the interior of the final ticket. Other U-shaped tear lines 65 define strips 95 in panel 44 and provide access to region 63 of panel 45.

Preprinted indicia 48 and 49 are supplied to the web on the upper surface of panel 43 and the lower surface of panel 44 at station 12 during preliminary processing of the web. Line holes 71 and 72 and various fold lines are also supplied at this time.

The particular glue pattern of the present embodiment is illustrated in FIGS. 4 and 5 and is supplied in a manner similar to that used to print inked indicia, permitting complex patterns to be generated while maintaining close tolerances. Thus it is possible to substantially surround the periphery of an article pocket, here region 63, with adhesive 11, forming a seal between plies, thereby encasing concealed indicia. Where self-stick adhesive is utilized the glue pattern on the upper surface of central panel 44 must be matched on the upper surface of panel 45 and the and the glue pattern on the lower surface of central panel 44 must be matched on the lower surface of panel 43 in order to be effective. However, when hot-melt glue is utilized the patterns may be varying, applied in the most effective manner, and in fact need only be applied to each surface of cental panel 44. After application of the so-called initially non-adherent adhesive 11, the form 30 is accumulated at station 50 as shown in FIG. 2 and may be accordion folded, rolled or otherwise accumulated in an endless series of connected blanks. The form is then adapted to be printed, sealed and separated into individual articles for distribution as illustrated in FIG. 3.

The form 30 is advanced through a computer or other controlled printer at station 32 where original indicia, for example indicia 91 provided on the upper surface of panel 43 and indicia 90 provided in region 63 of panel 45 is supplied as illustrated in FIG. 4. Sprocket or line holes 71 and 72 are useful in properly advancing the form through the printer.

After application of original indicia 90 and 91, the form is continuously accordion folded at station 34, placing each set of contiguous panels 43, 44 and 45 in registered zig-zag relationship thereby concealing indicia 90 in an enclosed pocket between panels 44 and 45. The accordion fold places the upper surface of panel 45 in abutting relationship with the upper surface of panel 44 and the lower surface of panel 44 in abutting relationship with the lower surface of panel 43, the upper surface of panel 43 becoming the exterior surface of the article.

Glue 11 is activated at station 36 by heating or other suitable means to bond abutting plies to one another and seal the concealed indicia in a closed pocket. The form 30 is next longitudinally cut or slit at station 38 along lines 81 to separate the side-by-side tickets from one another, and along lines 79 and 80 to remove the excess margins 69 and 70 including line holes 71 and 72 and inventory control data.

The final article is of three-ply construction having under ply 45, intermediate ply 44 and cover ply 43 wherein the cover ply 43 and the under ply 45 bear directly applied, original indicia 91 and 90, respectively. The continuous series of tickets is then burst apart at boundary lines 51, 52 and the like to provide individual tickets at 40 for distribution at 41 of FIG. 3.

Figure 7:
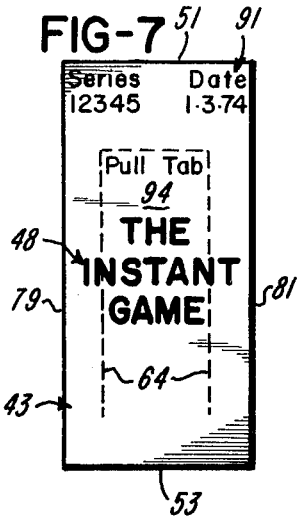
Figure 8:
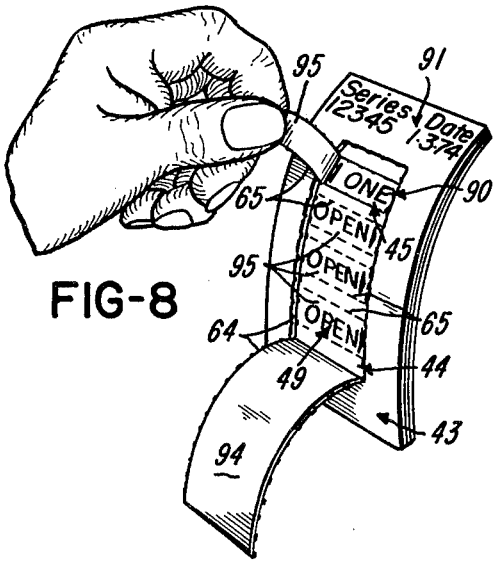

A typical completed ticket is illustrated in FIGS. 7 and 8. U-shaped tear line 64 in panel 43 generates a tear strip 94 providing access to the pocket between the intermediate panel 44 and cover panel 43, exposing tear strips 95 each defined by a U-shaped tear line 65. Each of these tear strips may be opened as illustrated in FIG. 8 to expose the various concealed original indicia 90.

Figure 9:
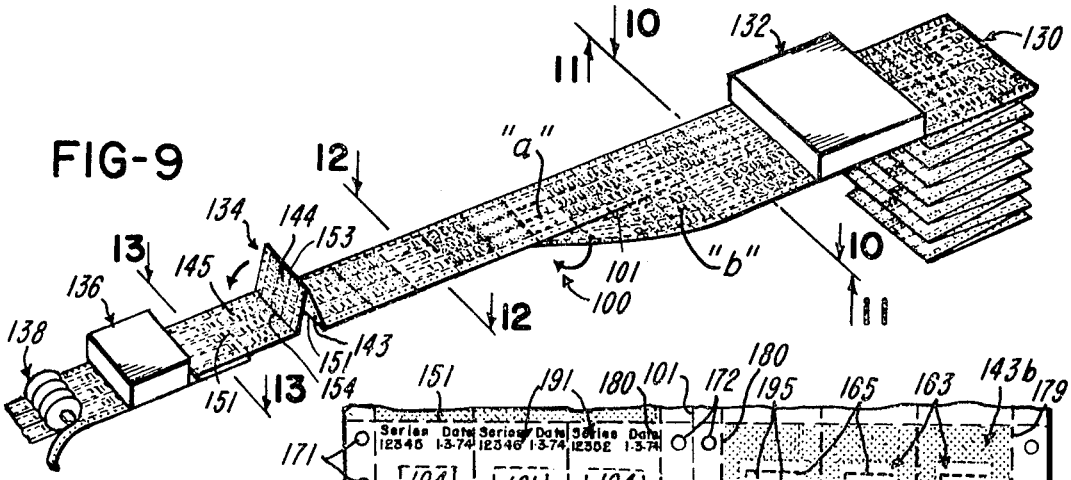
FIG. 9 diagrammatically illustrates a modification in the steps of the method of FIGS. 1–3.

A modification to the steps of FIGS. 1–3 is illustrated in FIG. 9 wherein each panel of each set of contiguous panels is subdivided by line 101 into a pair of duplicate bisections which are folded into direct overlying relationship as illustrated at station 100 in FIG. 9, defining a printed article blank consisting of three contiguous two-ply panels. As in the earlier embodiment, each set of contiguous two-ply panels is then accordion folded into registered zig-zag relationship at station 134, thereby generating a six-ply lottery ticket. The continuous form 130 is identical in principle to that of form 30 and, therefore, elements of the form are indicated by numerals in the hundred series corresponding to similar elements in FIGS. 4–8.

Figure 10:
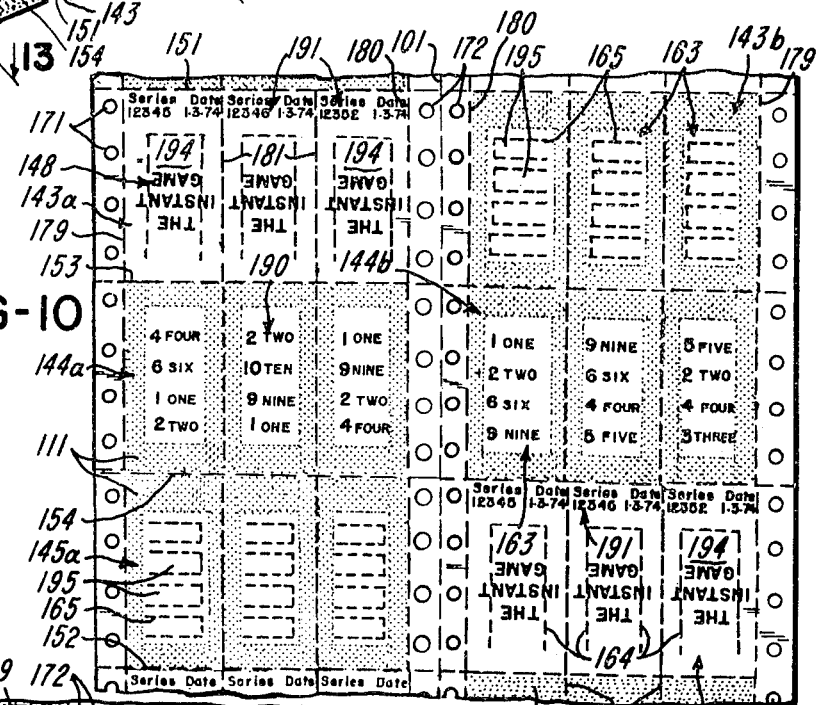
Figure 11:
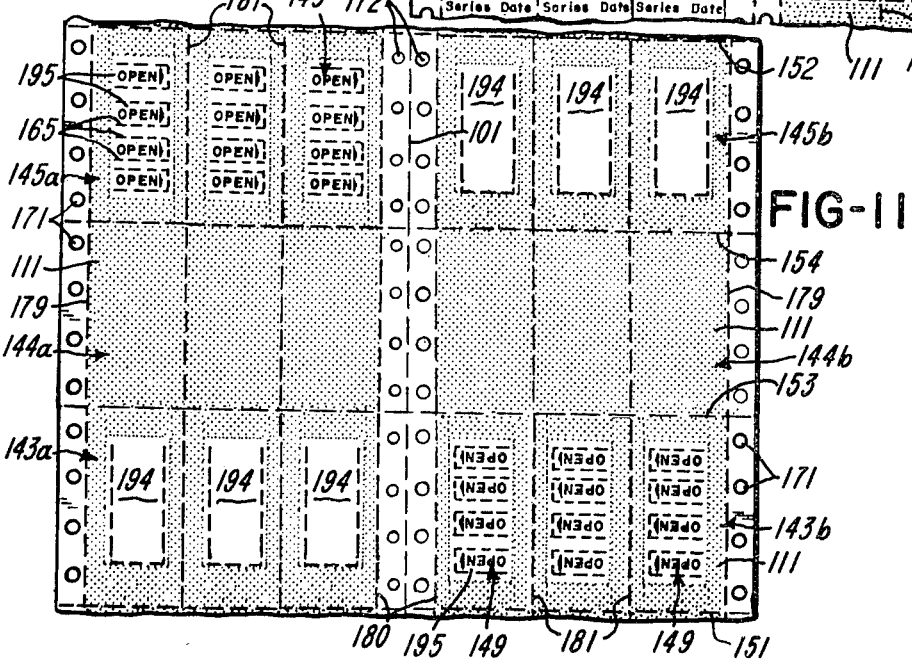

The continuous form 130 is prepared by the steps of a process like that of FIGS. 1 and 2, the upper surface thereof illustrated in FIG. 10 after application of original indicia 190 and 191. The lower surface of the form is illustrated in FIG. 11. The web is again transversely subdivided into blankets at lines 151, 151 and the like, each blank consisting of three contiguous panels 143, 144 and 145 defined by lines 153 and 154, wherein each panel has been longitudinally subdivided into a pair of duplicate subpanels 143*a*, 143*b*, 144*a*, 144*b*, 145*a* and 145*b* by continuous longitudinal fold line 101. As before, indicia 148 and 149 may be preprinted on the form at station 12 of FIG. 1, see FIGS. 10 and 11, and line or sprocket holes 171 and 172 are included to facilitate progression of the form through the processing steps.

The particular glue pattern of the second embodiment is illustrated in FIGS. 10 and 11. Where a hot-melt adhesive is utilized only the upper surface (FIG. 10) of the centralmost panel and the lower surface (FIG. 11) of subpanels *a* or subpanels *b* need be coated with glue 111, and where a self-stick adhesive is used, the pattern must conform to that particularly illustrated. As before, the adhesive 111 completely surrounds the periphery of pocket areas 163 of each panel, forming a seal between plies and thereby encasing concealed indicia in a closed, seal pocket area. Thus, when original indicia 190 is applied to region 163 of the upper surface of subpanels 144*a* and 144*b* and later concealed when covered by panels 143 and 145 the indicia is completely sealed along all four margins by glue 111, making improper exposure and access impractical.

After application of glue 111, the form is advanced through computer printing stating 32 for addition of indicia 190 and 191. The web is then continuously folded at 100 as illustrated in FIG. 9 placing the subpanels *a* and *b* in direct overlying relationship, see FIG. 12. The form is next accordion folded at 134, disposing panels 143, 144 and 145 into registered zig-zag relationship as illustrated in FIG. 13, generating a series of interconnected six-ply lottery tickets, the relationship of the folded panels being specifically illustrated in FIG. 14. After glue 111 has been activated at 136 and excess marginal portions have been removed at 138, the individual tickets are separated for distribution.

A typical completed ticket, illustrated in FIG. 15, includes tear strips 194 and 195, defined by the U-shaped tear lines 164 and 165 which provide access to the concealed indicia 190 on the upper surface of panels 144*a* and 144*b*.

A third embodiment of the present invention is included in FIGS. 16–24 wherein FIG. 16 diagrammatically illustrates a modification in the process of FIGS. 1–3 and FIGS. 17–24 illustrate the steps in producing the form and articles from the method of FIGS. 1, 2, 3 and 16. The form is identical to earlier embodiments in principle, with differences being drawn to detail. Therefore, like elements are referred to by like numerals of the two hundred series.

Figure 17:
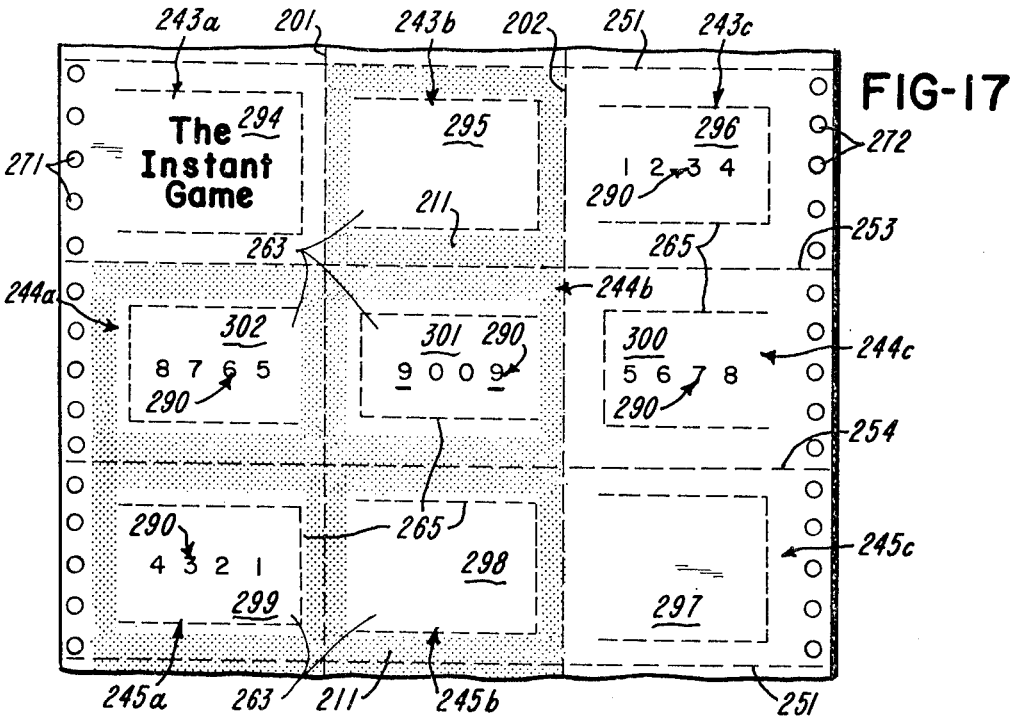
FIGS. 17–24 illustrate the various steps for producing a third continuous form by the process of FIGS. 1–3 when including the modification of FIG. 16, and a lottery ticket obtained therefrom.
Figure 18:
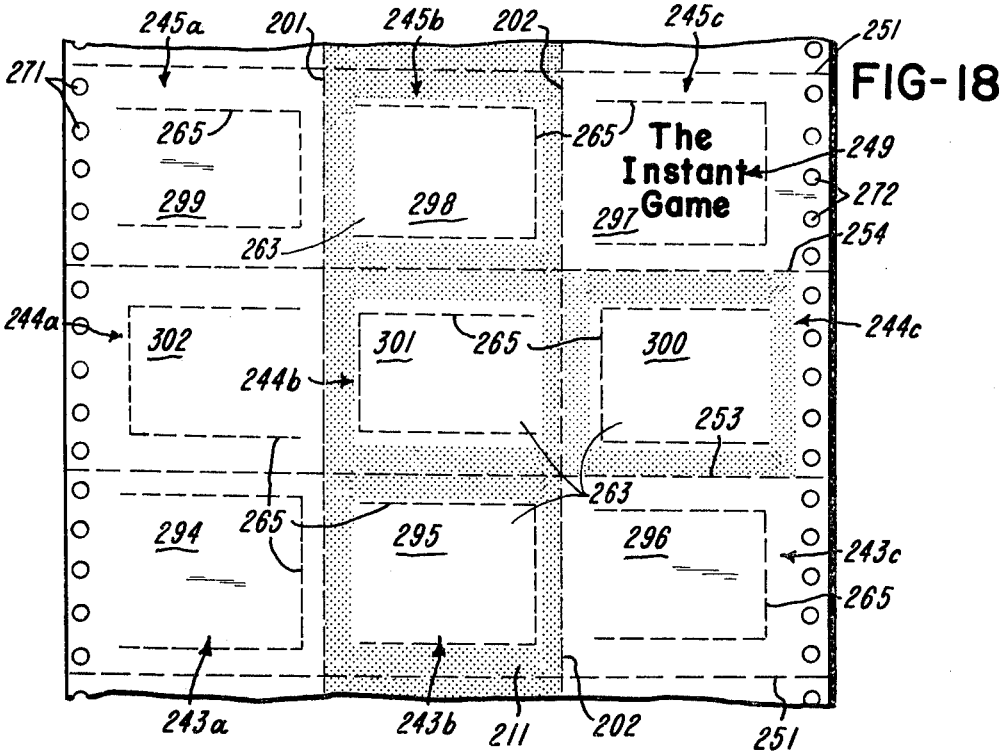

Each set of three contiguous panels is longitudinally trisected into subpanels 243*a*, 243*b*, 243*c*, 244*a*, 244*b*, 244*c*, 245*a*, 245*b* and 245*c* along lines 201 and 202 as illustrated in FIGS. 17 (upper surface) and 18 (lower surface). After printing at station 232, the subpanels *a*, *b* and *c* are each longitudinally accordion folded into zig-zag registered relationship at 200 of FIG. 16, thereby generating a series of connected blanks each comprising a set of three contiguous three-ply panels 243, 244 and 245, see FIG. 19. When the panels are accordion folded at station 234, a nine-ply ticket having original indicia on the interior surface of various closed pockets is generated, see FIG. 20. The particular glue pattern 211 of the third embodiment, illustrated in FIGS. 17 and 18, surrounds the pocket area 263 of each subpanel. The glue pattern as illustrated is utilized when a hot-melt glue or the like is utilized, glue being applied to the upper surfaces of subpanel 243*b*, 244*a*, 244*b*, 245*a* and 245*b* (FIG. 17) and to the lower surfaces of 243*b*, 244*b*, 244*c* and 245*b* (FIG. 18). Where self-stick adhesive or the like is utilized glue would be required on all but the upper surface of subpanel 243*a* and lower surface of subpanel 245*c*, i.e., the exterior surfaces of the final article.

Figure 19:
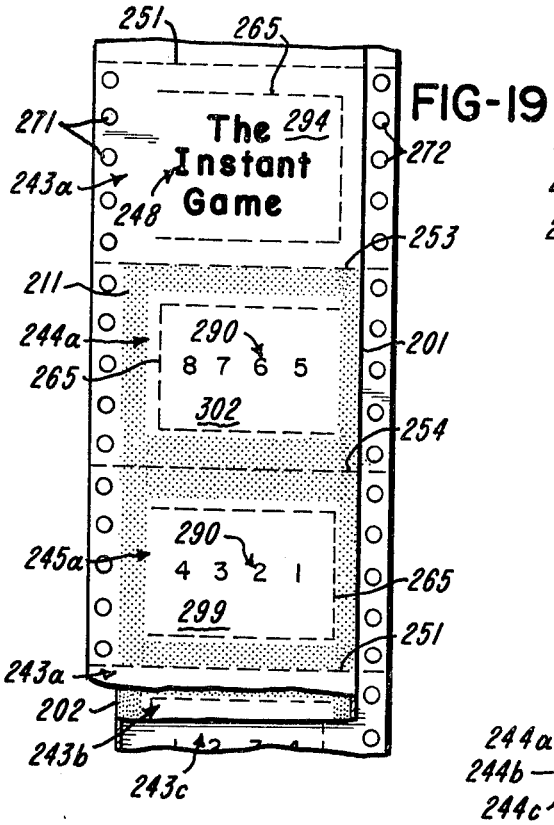
Figure 20:
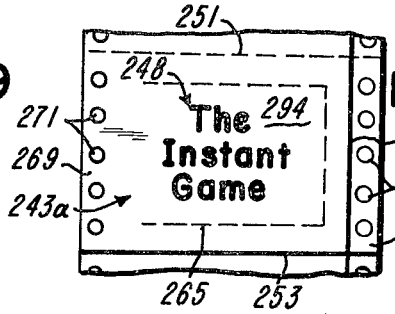
Figure 21:
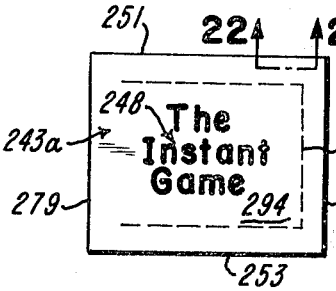
Figure 22:
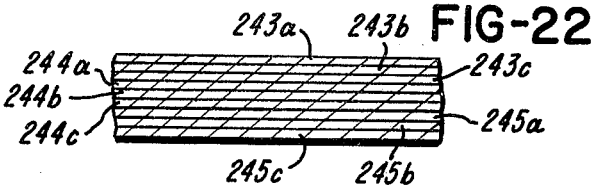
Figure 23:
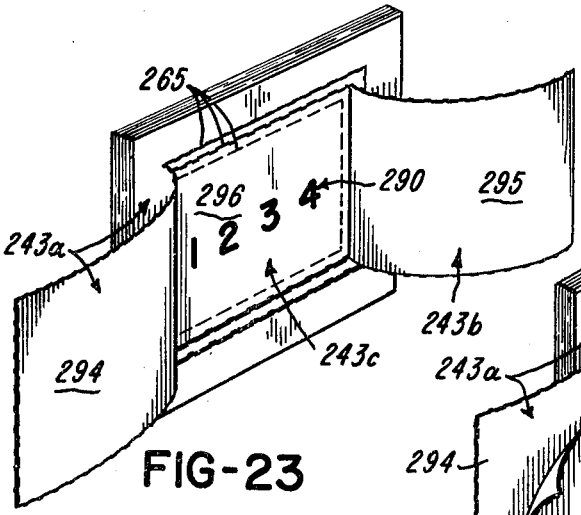
Figure 24:
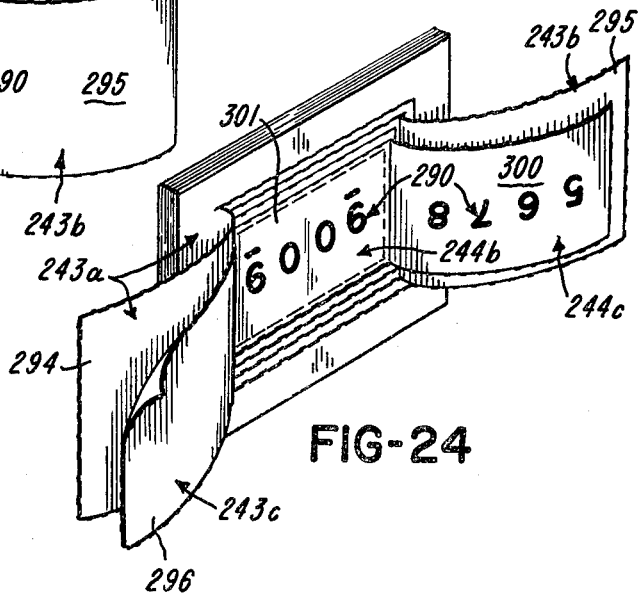

After application of original indicia 290 to regions 263 of the upper surface of subpanels 243*c*, 244*a*, 244*b*, 244*c*, and 245*a* the various subpanels are longitudinally accordion folded at 200 into registered zig-zag relationship as illustrated in FIG 19 forming a series of connected blanks each defined by a set of three contiguous three-ply panels 243, 244 and 245. The panels are then folded into registered zig-zag relationship at 234 as illustrated in FIG. 16, generating a series of nine-ply tickets. The glue is next activated at 236, and the excess margins 269 and 270 are removed, with the individual tickets being separated and distributed as shown in FIGS. 21 and 22. Various graduated tear strips 294, 295, 296, 297, 298, 299, 300, 301 and 302, each respectively defined by a U-shaped tear line 265, are disposed in registered relationship as shown in FIGS. 23 and 24, providing access to the printed indicia.

In summary, I have provided a variety of continuous forms each defining a series of multi-ply articles, such as lottery tickets or the like wherein original, directly applied indicia is applied to a concealed portion of an interior surface of the pocket of the final article. Each of the articles includes three basic panels which are accordion folded into registered zig-zag relationship while in single or multiple ply relationship for providing a final multi-ply article having various abutting plies forming closed pockets therebetween for concealing original, directly applied indicia. While the forms vary in detail, illustrating various features of the invention, all are generated from the general steps illustrated in FIGS. 1, 2 and 3 with modifications as illustrated in FIGS. 9 and 16.

The final articles produced from each of the forms obtained particularly by the processes of either FIG. 3, 9 or 16 each incorporate pattern gluing to generate a substantial seal between abutting plies forming a closed pocket containing original indicia. Access panels are provided inward of the seal on the various plies for exposing the original indicia. While each of the embodiments incorporates various features of the invention, it should be understood that these embodiments could be combined in any fasion to produce still other articles varying in detail but identical in principle to those disclosed. Further, it should be understood that the method, continuous forms, and articles here described are merely illustrative and are not intended to restrict the spirit of the invention or limit the scope of the appended claims.

What is claimed is:

1. A multi-ply lottery ticket comprising:

a single elongate sheet of material having a pair of foldlines extending transversely thereacross to define three contiguous end edge connected panels, said sheet being accordian folded with said panels being disposed in a zig-zag relationship to define a concealed area having opposed first and second interior faces and an exterior face on a common side of said sheet;

a plurality of elongate original indicia located in the concealed area on said second interior face;

an elongate outer hinged tear strip for providing access to the interior of said folded sheet, said strip being defined in said exterior face to be longitudinally disposed on said exterior face and having a hinge located adjcaent a first one of said foldlines, said exterior face having original directly applied indicia positioned thereon;

a plurality of elongate interior hinged tear strips for providing access to the original indicia on said second interior face, said interior tear strips each being defined in the panel including said first interior face to have the longitudinal axis thereof oriented transversely of said outer tear strip and hinged to open outwardly through said exterior face after said outer hinged tear strip has been opened, said interior tear strips having outer faces which are exposed when said outer tear strip is opened, each of the original indicia on said second interior face being longitudinally aligned with a corresponding one of said interior tear strips and being located to be exposed when said corresponding interior tear strip is opened so that said elongate indicia can be viewed from outside the ticket with both said outer and interior tear strips are open, said original applied indicia directly applied to said exterior face and said second interior face in a single printing run;

initially inactive adhesive applied to peripheral portions of the surfaces of said panels which are in abutting contact when said panels are accordion folded for forming a permanent seal between said abutting surfaces to permanently bond to one another those portions of said abutting surfaces bordering said outer tear strip, said interior hinged tear strips and the indicia in the concealed area on said second interior face so that said bonded panels must be mutilated to separate same when said adhesive is activated.

2. An article as called for in claim 1, wherein the adhesive comprises hot-melt glue provided on one contacting surface of each pair of abutting panels.

3. An article as called for in claim 1, wherein the adhesive comprises a self-stick adhesive provided on each contacting surface of each pair of abutting panels.

4. An article as called for in claim 1, wherein said adhesive is on a portion of both surfaces of the centralmost panel.

5. An article as called for in claim 1, wherein the adhesive is a self-stick adhesive which is adherent only to another surface having self-stick adhesive thereon, and wherein said adhesive is provided on portions of an upper surface of both the centralmost panel and one other panel and portions of a lower surface of both the centralmost panel and yet another panel of.

6. An article as called for in claim 1, wherein the panels of each blank are each longitudinally subdivided into a plurality of duplicate subpanels.

7. An article as called for in claim 1, wherein the panels of each blank are each longitudinally trisected into three subpanels.

8. An article as called for in claim 1, wherein the panels of each sheet are each longitudinally bisected into a pair of subpanels.

* * * * *